US007594734B2

(12) United States Patent
Bacon et al.

(10) Patent No.: US 7,594,734 B2
(45) Date of Patent: Sep. 29, 2009

(54) LIGHT FIXTURE DIFFUSOR

(75) Inventors: Ted Bacon, Colliersville, TN (US); John R. Klaus, Bartlett, TN (US); Karl Lindroth, Oakland, TN (US)

(73) Assignee: Hunter Fan Company, Memphis, TN (US)

( * ) Notice: Subject to any disclaimer, the term of this patent is extended or adjusted under 35 U.S.C. 154(b) by 484 days.

(21) Appl. No.: 11/145,072

(22) Filed: Jun. 2, 2005

(65) Prior Publication Data

US 2006/0274538 A1 Dec. 7, 2006

(51) Int. Cl.
*F21S 8/00* (2006.01)

(52) U.S. Cl. ..... 362/147; 362/267; 362/343; 362/355; 362/363; 362/374

(58) Field of Classification Search ..... 362/147, 362/343, 355, 363, 267, 374
See application file for complete search history.

(56) References Cited

U.S. PATENT DOCUMENTS

| | | | | |
|---|---|---|---|---|
| 1,089,869 | A | 3/1914 | Ripley | |
| 1,746,339 | A | 2/1930 | Doane | |
| 1,769,481 | A | 7/1930 | Zahm | |
| 3,108,753 | A | 10/1963 | Coffey | 240/128 |
| 3,524,981 | A | 8/1970 | Auerbach | |
| 4,099,224 | A | 7/1978 | Valpey | 362/433 |
| 4,175,282 | A | 11/1979 | Grindle et al. | 362/363 |
| 4,428,032 | A | 1/1984 | Workman | 362/96 |
| 4,514,792 | A * | 4/1985 | Klaus | 362/294 |
| 4,754,383 | A | 6/1988 | Kluas | 362/363 |
| 4,764,855 | A | 8/1988 | Fretz, III et al. | 362/433 |
| 5,034,869 | A | 7/1991 | Choi | 362/363 |
| 5,491,618 | A | 2/1996 | Vakil | 362/147 |
| 5,653,532 | A | 8/1997 | Chan | 362/453 |
| 6,428,188 | B1 | 8/2002 | Magno, Jr. | 362/253 |
| 2005/0265016 | A1 * | 12/2005 | Rappaport | 362/147 |

* cited by examiner

*Primary Examiner*—Sandra L O'Shea
*Assistant Examiner*—Meghan K Dunwiddie
(74) *Attorney, Agent, or Firm*—Baker Donelson

(57) ABSTRACT

A light diffusor (12) is disclosed which includes a translucent or transparent light diffusing portion (24) and a rigid mounting neck (25) coupled to the diffusing portion (24). The diffusing portion (24) has an inwardly extending flange (27) with a series of mounting hole (28) therein. The mounting neck (25) has a generally cylindrical, upright section (30) and an inwardly extending mounting flange (31). The neck inwardly extending mounting flange (31) has a series of mounting holes (33). The light diffusor also has first annular gasket (35) mounted between the mounting neck flange (31) and the diffusing portion flange (27), a second gasket (37) mounted below the diffusing portion flange, and three mounting brackets (40) mounted below the second gasket (37). The first gasket, second gasket and mounting brackets all have mounting holes (36), (37) and (41), respectively. A mounting screw or bolt 43 extends through each neck mounting hole (33), first gasket mounting hole (36), diffusor portion mounting hole (28), and second gasket mounting hole (38), and threads into a bracket mounting hole (41) to couple the light diffusing portion to the mounting neck.

8 Claims, 3 Drawing Sheets

LIGHT FIXTURE DIFFUSOR

TECHNICAL FIELD

This invention relates generally to light fixtures, and specifically to the diffusor of a light fixture for a ceiling fans.

BACKGROUND OF THE INVENTION

Ceiling fans powered by electric motors have been used for years in circulating air. They typically have a motor within a housing mounted to a downrod that rotates a set of fan blades about the axis of the downrod. The fan may also include a light fixture.

Ceiling fan light fixtures typically include one or more glass light diffusers which may be in the form of a single globe or a plurality of shades. Each diffusor is retained by a mounting structure affixed to the ceiling fan. The glass light diffusers typically include a lower portion which may include an ornament design and may assume a variety of shapes and configurations, and a substantially cylindrical portion extending upwardly from the lower portion. The light diffusers of conventional ceiling fan light fixtures are typically retained in one of the following two ways. A plurality of circumferentially spaced set screws may be used, with the set screws protruding radially inwardly through a cylindrical flange of the mount structure affixed to the fan, until they are in contacting engagement with the neck portion of the glass light diffusor. The light diffusor is then retained in place by the friction created by the contacting engagement between the set screws and the neck portion of the light diffusor. The force exerted by the set screws may crack the fragile neck of these glass diffusers should they be overly tightened.

In other conventional ceiling fan light fixtures, the substantially cylindrical neck portion of the light diffusor includes a helical threaded portion which engages protuberances in an annular flange of the mount structure, as shown in U.S. Pat. No. 6,428,188. The manufacturing of these light diffusers may be difficult due to the multiple protuberances of the neck of those globes or shades which are threaded in place. It has been found that the glass material does not hold tolerances well as the material can shrink or expand in diameter due to variables in the molding process.

In view of the foregoing deficiencies associated with known light fixtures in general, and light fixtures for ceiling fans in particular, there remains a need for a light diffusor that is easy to manufacture and which will not break should mounting screws be utilized. It thus is to the provision of such that the present invention is primarily directed.

SUMMARY OF THE INVENTION

A light diffusor comprises a translucent light diffusing portion having a mounting flange with a plurality of mounting holes therein, a mounting neck having a mounting flange with a plurality of mounting holes therein configured to align with the light diffusing portion mounting holes, and a plurality of mounting bolts coupling the translucent light diffusing portion to the mounting neck. Each mounting bolt extends through one light diffusing portion mounting hole and one neck mounting hole.

DETAILED DESCRIPTION

Figure 1:
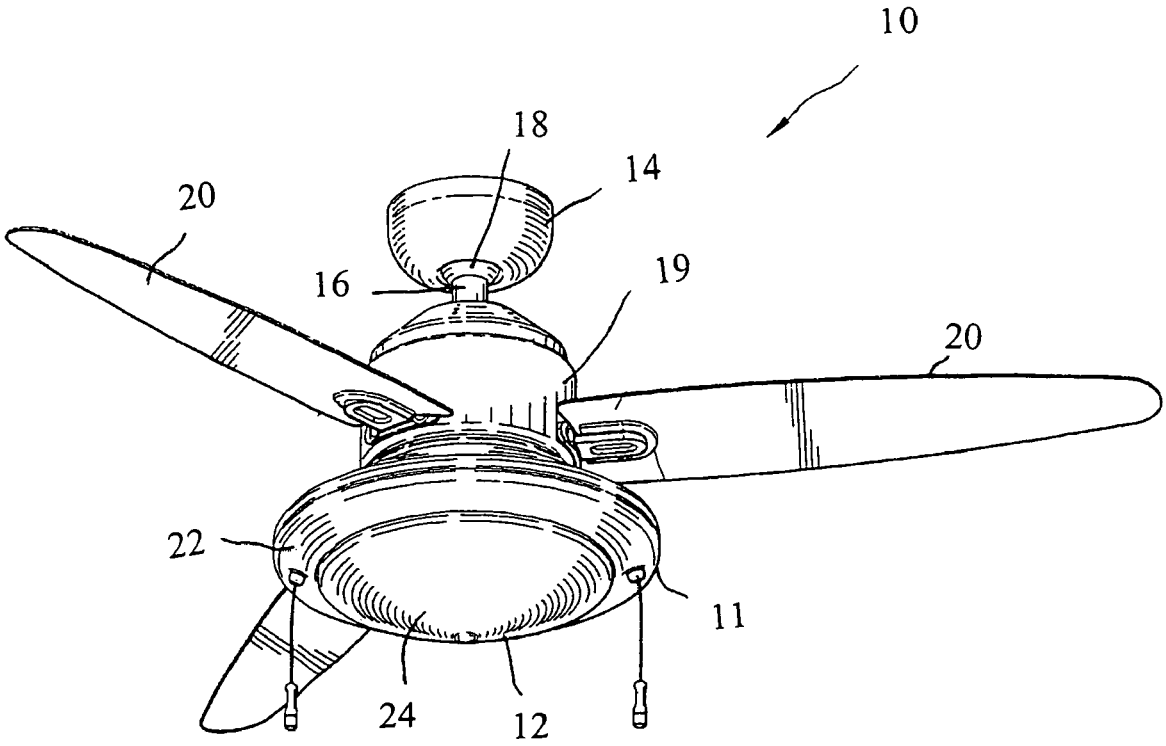
FIG. 1 is a perspective view of a ceiling fan including a light diffusor embodying principles of the invention in a preferred form.
Figure 2:
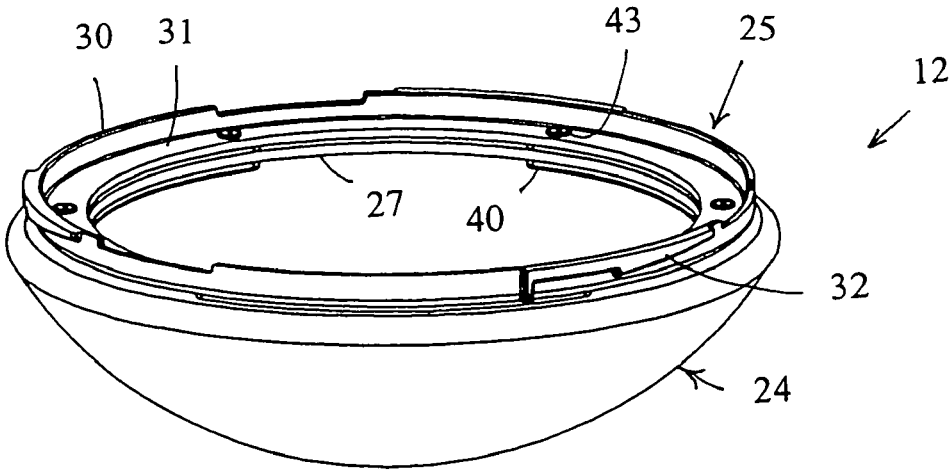
FIG. 2 is a perspective view of the light diffusor of FIG. 1.
Figure 3:
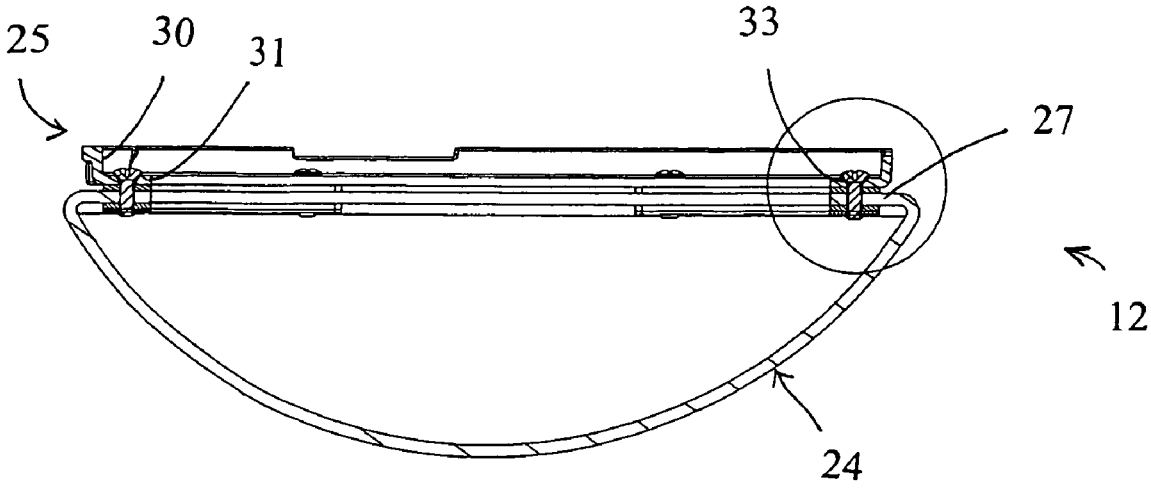
FIG. 3 is a cross-sectional view of the light diffusor of FIG. 1.
Figure 4:
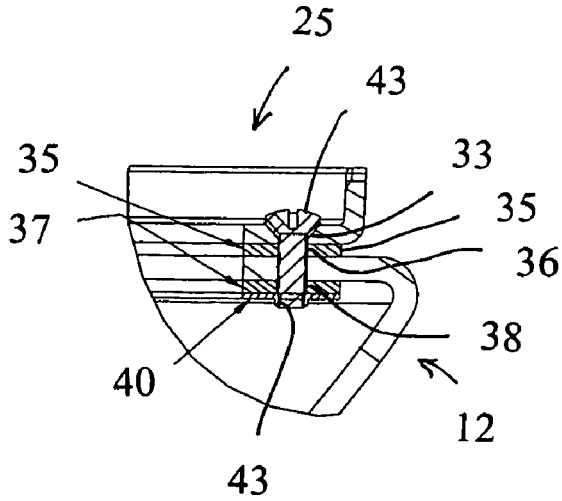
FIG. 4 is a cross-sectional view of a portion of the light diffusor of FIG. 1.
Figure 5:
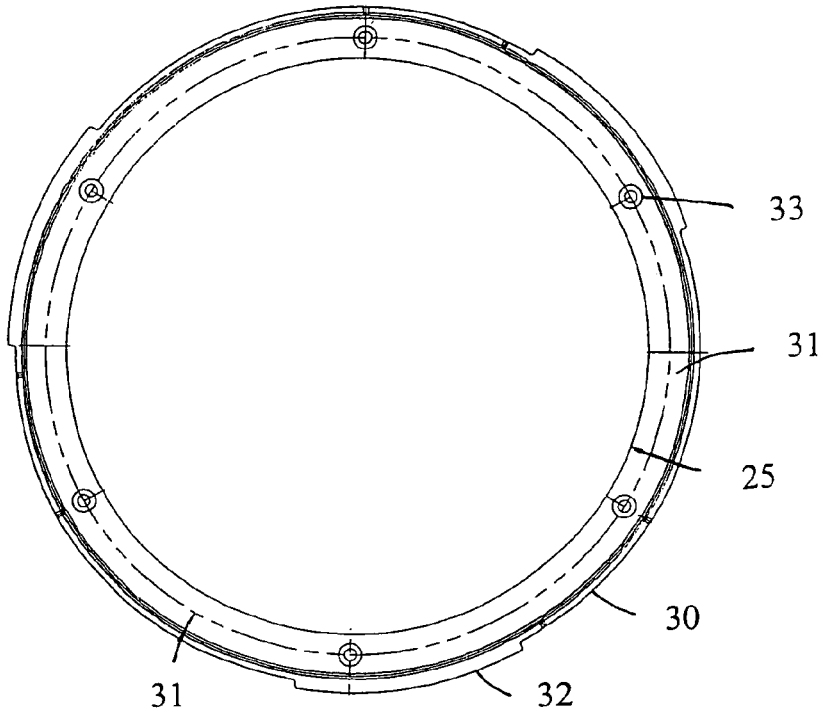
FIG. 5 is a top view of the neck portion of the light diffusor of FIG. 1.
Figure 6:
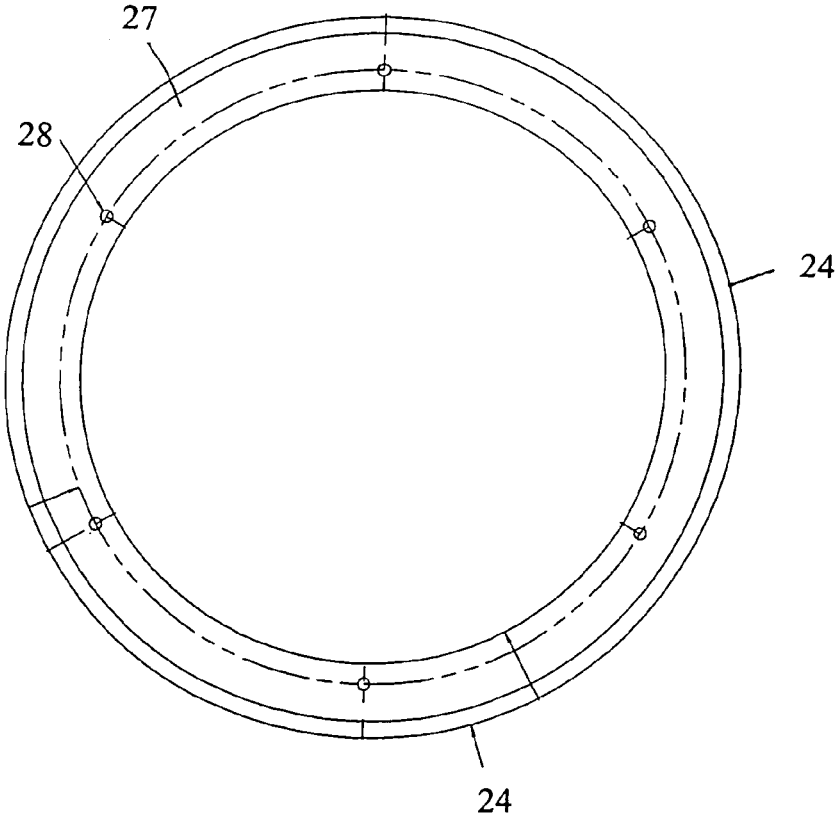
FIG. 6 is a top view of the light diffusing portion of the light diffusor of FIG. 1.
Figure 7:
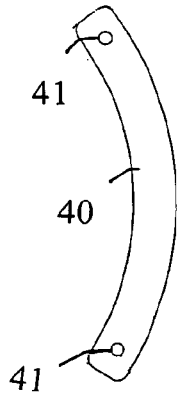
FIG. 7 is a top view of the mounting bracket of the light diffusor of FIG. 1.

Referring now to the drawings, wherein like reference numerals have been used for similar elements throughout, FIG. 1 is a perspective view illustrating a ceiling fan 10 which incorporates a light fixture 11 having a diffusor 12 according to the present invention. It should be understood that the particular features of ceiling fan 10 do not form a part of the present invention and are shown by way of illustration, not of limitation. The light fixture diffusor of the present invention may be advantageously utilized in conjunction with a wide variety of other ceiling fans. Furthermore, the light fixture diffusor according to the present invention may be used in conjunction with ceiling fans having a wide variety of configurations with regard to the included motor housing, blade irons, fan blades, etc. As yet another alternative, the light fixture diffusor according to the present invention may be mounted directly to overhead structures other than those comprising a stationary portion of a ceiling fan. For instance, the light fixture diffusor may be mounted directly to a ceiling of a structure or to a mount plate affixed to the ceiling. Lastly, the light fixture diffusor may be in the form of multiple glass shades rather than a single glass globe.

In the illustrative embodiment shown in FIGS. 1-7, ceiling fan 10 is suspended from a ceiling (not shown) of a residential or commercial structure, by a canopy 14 and downrod 16 arrangement. A ball 18 is affixed to an upper end of the downrod 16 and is pivotally disposed within a seat (not shown) formed in the canopy 14 to allow the ceiling fan 10 to pivot somewhat, for instance to accommodate a vaulted or sloped ceiling. The downrod 16 supports an electric motor encased within a motor housing 19. Ceiling fan 10 further includes a plurality of fan blades 20 which are coupled to a rotating portion of ceiling fan motor.

The light fixture 11 includes a reflector plate 22 and light bulb assembly, which are mounted to the bottom of the ceiling fan motor housing 19, and a light diffusor 12. The light diffusor 12 has a translucent or transparent light diffusing portion 24, shown in the form of an inverted translucent dome, and a rigid mounting neck 25 coupled to the diffusing portion 24, the structure is similar to that shown in U.S. Pat. No. 6,428,188 which is specifically incorporated herein. Preferably, the diffusing portion 24 is made from a material such as glass while the mounting neck 25 is made of a material such as metal.

The diffusing portion 24 has an inwardly extending flange 27 with a series of mounting hole 28 therein. The mounting neck 25 has a generally cylindrical, upright section 30, an inwardly extending mounting flange 31, and three outwardly extending ridges 32 extending from the upright section 30 which are configured to mate with corresponding protuberances extending from reflector plate 22. The neck inwardly extending mounting flange 31 has a series of mounting holes 33 configured to align with the mounting holes 28 of the diffusing portion 24. A first annular gasket 35, made of a resilient material such as silicone, is mounted between the mounting neck flange 31 and the diffusing portion flange 27. The first gasket 35 has a series of mounting holes 36 which are configured to align with the mounting holes 28 of the diffusing portion flange. A second annular gasket 37, of similar material, is mounted below the diffusing portion flange. The second gasket 37 also having a series of mounting holes 38 which are alignable with mounting holes 28 of the diffusing portion flange. Lastly, three mounting brackets 40 are mounted below the second gasket 37. Each mounting bracket 40 has two threaded mounting holes 41 which are configured to align with two adjacent mounting holes 38 of the second gasket 37. A mounting screw or bolt 43 extends through each neck mounting hole 33, first gasket mounting hole 36, diffusor portion mounting hole 28, and second gasket mounting hole 38, and threads into a bracket mounting hole 41.

The diffusor metallic neck greatly reduces manufacturing problems with the formation of threading ridges in the neck, a problem associated with necks made of the same glass material as that of the diffusing portion. Furthermore, the metallic neck does not break under the stress exerted by overly tightened set screws. As such, the metal neck provides distinct advantages over the glass necks of the prior art.

It should be understood that the present invention is also directed to many different types of ceiling lights and to ceiling fan diffusors in the form of light shades, such as those shown in U.S. Pat. No. 6,350,045, which is specifically incorporated herein. Furthermore, the orientation of the flanges need not be inwardly, as the present invention may also includes light fixtures wherein the flanges of the neck, globe or both, may extend outwardly. The diffusing portion may be coupled to the neck through any conventional means such as clamps, rivets, clasps, brackets, and the like.

Lastly, it should also be understood that the metal neck may be adapted to threadably receive the mounting screw, rather than having the mounting brackets 40.

It thus is seen that a ceiling fan light fixture diffusor now is provided which is easier to manufacture and is not susceptible to breakage from mounting it incorrectly, problems which are prevalent with those of the prior art. Although it has been shown and described in its preferred form, it should be understood that other modifications, additions or deletions may be made thereto without departure from the spirit and scope of the invention as set forth in the following claims.

The invention claimed is:

1. A light diffusor comprising:

a translucent light diffusing portion having a mounting flange with a plurality of mounting holes therein;

a mounting neck having a mounting flange with a plurality of mounting holes therein configured to align with said light diffusing portion mounting holes;

a plurality of mounting bolts coupling said translucent light diffusing portion to said mounting neck, each said mounting bolt extending through one said light diffusing portion mounting hole and one said neck mounting hole, and at least one mounting bracket mounted adjacent said diffusing portion mounting flange opposite said mounting neck mounting flange, said mounting bracket having threaded mounting holes configured to mateably receive said mounting bolts.

2. The light diffusor of claim 1 further comprising a first gasket positioned between said diffusing portion mounting flange and said mounting neck mounting flange.

3. The light diffusor of claim 2 further comprising a second gasket positioned between said diffusing portion mounting flange and said mounting bracket.

4. A light diffusor comprising:

a translucent light diffusing portion having a mounting flange with a plurality of mounting holes therein;

a mounting neck having a mounting flange with a plurality of mounting holes therein configured to align with said light diffusing portion mounting holes;

a plurality of mounting bolts coupling said translucent light diffusing portion to said mounting neck, each said mounting bolt extending through one said light diffusing portion mounting hole and one said neck mounting hole, and a first gasket positioned between said diffusing portion mounting flange and said mounting neck mounting flange.

5. A light diffusor comprising:

a translucent light diffusing portion having a mounting flange with a plurality of mounting holes therein;

a mounting neck having a mounting flange with a plurality of mounting holes therein;

coupling means for coupling said diffusing portion mounting flange to said mounting neck mounting flange, said coupling means comprises a plurality of bolts extending through said diffusing portion mounting flange holes and said mounting neck mounting flange holes, and at least one mounting bracket mounted adjacent said diffusing portion mounting flange opposite said mounting neck mounting flange, said mounting bracket having threaded mounting holes configured to mateably receive said mounting bolts.

6. The light diffusor of claim 5 further comprising a first gasket positioned between said diffusing portion mounting flange and said mounting neck mounting flange.

7. The light diffusor of claim 6 further comprising a second gasket positioned between said diffusing portion mounting flange and said mounting bracket.

8. A light diffusor comprising:

a translucent light diffusing portion having a mounting flange with a plurality of mounting holes therein;

a mounting neck having a mounting flange with a plurality of mounting holes therein;

coupling means for coupling said diffusing portion mounting flange to said mounting neck mounting flange, said coupling means comprises a plurality of bolts extending through said diffusing portion mounting flange holes and said mounting neck mounting flange holes, and a first gasket positioned between said diffusing portion and said mounting neck.

* * * * *